US007908819B2

(12) United States Patent
Neuhofer, Jr.

(10) Patent No.: US 7,908,819 B2
(45) Date of Patent: Mar. 22, 2011

(54) DEVICE FOR BRIDGING A DIFFERENCE IN HEIGHT BETWEEN TWO FLOOR SURFACES

(76) Inventor: Franz Neuhofer, Jr., Zell Am Moos (AT)

( * ) Notice: Subject to any disclaimer, the term of this patent is extended or adjusted under 35 U.S.C. 154(b) by 0 days.

(21) Appl. No.: 12/804,747

(22) Filed: Jul. 28, 2010

(65) Prior Publication Data

US 2010/0293886 A1 Nov. 25, 2010

Related U.S. Application Data

(62) Division of application No. 10/590,949, filed as application No. PCT/AT2005/000017 on Jan. 25, 2005, now Pat. No. 7,814,720.

(30) Foreign Application Priority Data

Feb. 27, 2004 (AT) ..... 318/2004

(51) Int. Cl.
*E04B 1/00* (2006.01)

(52) U.S. Cl. ..... 52/747.1; 52/471; 52/396.04

(58) Field of Classification Search ..... 52/471, 52/459, 396.04, 464, 747.1; 83/102.1
See application file for complete search history.

(56) References Cited

U.S. PATENT DOCUMENTS

| | | | |
|---|---|---|---|
| 3,543,326 | A | 12/1970 | Rohrberg et al. |
| 3,665,666 | A | 5/1972 | Delcroix |
| 3,667,177 | A | 6/1972 | Biela |
| 4,067,155 | A | 1/1978 | Ruff et al. |
| 4,736,563 | A | 4/1988 | Bilhorn |
| 4,893,449 | A | 1/1990 | Kemper |
| 5,638,653 | A | 6/1997 | Rossi |
| 5,657,598 | A | 8/1997 | Wilbs et al. |
| 6,230,385 | B1 | 5/2001 | Nelson |
| 6,345,480 | B1 | 2/2002 | Kemper et al. |
| 6,517,935 | B1 | 2/2003 | Kornfalt et al. |
| 6,550,192 | B1 | 4/2003 | Nelson et al. |
| 6,550,205 | B2 | 4/2003 | Neuhofer, Jr. |
| 6,588,165 | B1 | 7/2003 | Wright |
| 6,745,534 | B2 | 6/2004 | Kornfalt |
| 6,860,074 | B2 | 3/2005 | Stanchfield |
| D504,181 | S | 4/2005 | Stanchfield |
| 6,898,911 | B2 | 5/2005 | Kornfalt et al. |

(Continued)

FOREIGN PATENT DOCUMENTS

| | | |
|---|---|---|
| EP | 1 113 124 | 7/2001 |

(Continued)

OTHER PUBLICATIONS

International Search Report of PCT/AT2005/000017.

*Primary Examiner* — Basil Katcheves
(74) *Attorney, Agent, or Firm* — Collard & Roe, P.C.

(57) ABSTRACT

A device for bridging a difference in height between two floor surfaces (1, 3) is described, with said device comprising a profiled cover (4) that is provided with a covering flange (5) which covers the edge of each of the two floor surfaces (1, 3), with at least one clamping extension (6) that protrudes downward from the covering flange (5), extends longitudinally with respect to the profiled cover (4), and clamps into and engages with a fixture (7), with said device also comprising a compensating strip (10) located between the covering flange (5) of the profiled cover (4) and the lower of the two floor surfaces (1, 3). In order to create advantageous construction conditions it is proposed that the fixture (7) forms a clamping seat (11) for the compensating strip (10).

6 Claims, 2 Drawing Sheets

U.S. PATENT DOCUMENTS

| | | | |
|---|---|---|---|
| 7,065,931 | B2 | 6/2006 | Kornfalt et al. |
| 7,150,134 | B2 | 12/2006 | Kornfalt et al. |
| 7,207,143 | B2 | 4/2007 | Stanchfield |
| D542,939 | S | 5/2007 | Neuhofer, Jr. |
| D542,941 | S | 5/2007 | Neuhofer, Jr. |
| 7,287,357 | B2 | 10/2007 | Gomez Insa |
| 2003/0154678 | A1 | 8/2003 | Stanchfield |
| 2003/0159389 | A1 | 8/2003 | Kornfalt et al. |

FOREIGN PATENT DOCUMENTS

| | | |
|---|---|---|
| EP | 1 310 613 | 5/2003 |
| GB | 2 304 365 | 3/1997 |
| WO | WO 99/01628 | 1/1999 |
| WO | WO 03/040492 | 5/2003 |

DEVICE FOR BRIDGING A DIFFERENCE IN HEIGHT BETWEEN TWO FLOOR SURFACES

CROSS REFERENCE TO RELATED APPLICATIONS

This application is a divisional of U.S. application Ser. No. 10/590,949 filed on Nov. 8, 2006, which application is a national stage application under 35 U.S.C. §371 of PCT Application No. PCT/AT2005/000017 filed Jan. 25, 2005 which claims priority under 35 U.S.C. §119 from Austrian Patent Application No. A 318/2004 filed Feb. 27, 2004, the disclosures of each of which are hereby incorporated by reference.

BACKGROUND OF THE INVENTION

1. Field of the Invention

The invention relates to a device for bridging a difference in height between two floor surfaces, with said device comprising a profiled cover that is provided with a covering flange which covers the edge of each of the two floor surfaces and at least one clamping extension that protrudes downward from the covering flange, extends longitudinally with respect to the profiled cover, and clamps into and engages with a fixture. The said device also comprises a compensating strip located between the covering flange of the profiled cover and the lower of the two floor surfaces.

2. Description of the Prior Art

A known method for bridging steps or joints in floor coverings is disclosed in WO 99/01628 A1, wherein profiled covers for steps and joints are invisibly attached by means of fixtures. For this purpose, the fixtures consist of a profiled section with a flat horizontal fastening element on the floor side. Extending upward from this flat horizontal element are vertical retaining legs, between which the downwardly protruding clamping extension of the profiled cover is inserted and held in place. In order to bridge height differences between adjacent floor coverings, a hollow cavity is formed adjacent to and along the length of the clamping extension of the metallic profiled cover, allowing the flange of the profiled cover that extends from the clamping extension to bend in such a way that the angle of flex of the profiled cover can adjust to the height difference between the floor coverings to be bridged in each case.

Such an adjustment for height differences with respect to the floor coverings being bridged requires the profiled covers to have the requisite flexural properties, which for instance timber building materials do not possess. In order to facilitate a height adjustment between two floor coverings using timber materials accordingly, without the necessity of using various profiled covers, WO 03/040492 A1 discloses a profiled cover with a compensating strip arranged on the low floor side. This compensating strip is provided with an undercut groove for attachment to the underside of the covering flange of the profiled cover. The purpose of the groove is to accommodate a projection on the underside of the covering flange parallel to the clamping extension of the profiled cover in a form-fitting manner. The primary disadvantage of this known device for bridging a difference in height between two floor surfaces is that the projection on the underside of the covering flange hinders the manufacture of the profiled cover and that it is virtually impossible to achieve a form-fitting joint between the profiled cover and the compensating strip due to the unavoidable manufacturing tolerances resulting from the separate production of the profiled cover and the compensating strip. Moreover, the profiled cover can only be used without a compensating strip as a cover for an expansion joint between two level floor coverings if the projection on the underside of the covering flange is removed beforehand.

SUMMARY OF THE INVENTION

Consequently, the object of the invention is to develop a device for bridging a difference in height between two floor surfaces of the aforementioned type that is able to fulfill the requirements for the exact fit of a profiled cover and compensating strip, while still being simple to manufacture.

The invention fulfills this object by means of the fixture forming a clamping seat for the compensating strip. Consequently, as the resultant fixture for accommodating the clamping extension of the profiled cover also creates a clamping seat for the compensating strip there is no need for a form-fitting joint between the profiled cover and the compensating strip. This not only facilitates the manufacture of the profiled cover, but also of the compensating strip as there is no provision of a projection on the underside of the covering flange of the profiled cover nor the provision of a longitudinal groove in the covering strip. The absence of a projection on the underside of the cover flange of the profiled cover also means that the profiled cover can be used to bridge expansion joints between level sections of floor, without having to perform additional work on the profiled cover.

The fixture for the profiled cover and also for the compensating strip can be designed differently as the only important thing is to have corresponding clamping joints to ensure the reciprocal spatial correspondence of the profiled cover and the compensating strip. However, construction is particularly simple if the fixture consists of a known profiled section with resilient retaining legs protruding upwardly from a mounting plate for clamping the clamping extension of the profiled cover. The mounting plate on the low floor side extends past the retaining leg and bears the clamping seat for the compensating strip, which only needs to be pushed onto the clamping seat before the profiled cover with the clamping extension is clamped firmly between the retaining legs and the covering flange rests on the compensating strip. It is advantageous if the clamping seat for the compensating strip can be developed as a retaining leg engaging with a longitudinal channel in the compensating strip, with said leg firmly holding the profiled cover clamped in the profiled section of the fixture transversely to its longitudinal axis. In addition, the covering flange of the profiled cover for the compensating strip can form an abutment on the clamping extension side so that the local clamping extension forms an abutment such that the profiled cover and the compensating strip are not only held in position by the fixture, but also directly by the abutment.

With the retaining leg serving as a clamping seat there is the advantage that the compensating strip lies against the abutment of the covering flange due to the resilient pretensioning of the retaining leg, facilitating compensation of manufacturing tolerances. If the profiled cover is employed without the compensating strip, for instance to bridge an expansion joint, the widened part of the mounting plate of the fixture can hinder its placement inside the expansion joint. For this reason the section of the mounting plate extending beyond the retaining leg can be removed from the remaining mounting plate by means of a predetermined breaking point.

The underside of the covering flange without the projection is an essential requirement for a simple manufacturing process with respect to the profiled cover and the compensating strip. This manufacturing process is characterized in that initially a common profiled section is produced, the cross-section of which is formed from the cross-section of the profiled cover and at least one adjoining compensating strip, including machining allowances for kerfing on the underside of the covering flange on the one hand and on the lateral surface of the clamping extension on the other. Then the compensating strip is separated from the profiled cover by cutting along the underside of the covering flange and the lateral surface of the clamping extension. By manufacturing the profiled cover and the compensating strip from a common profiled section with separating cuts along the underside of the covering flange on the one hand and along the lateral surface of the clamping extension on the other, not only can the material for the profiled cover and the compensating strip be utilized advantageously, but also the precision of fit increased enormously as the deviations from the specified cutting plane for the profiled cover and the compensating strip correspond to each other when the profiled cover and the compensating strip are mated, allowing the profiled cover and the compensating strip to be joined without any play.

Although the profiled section can be limited to the simultaneous production of the profiled cover and a single compensating strip, it can be advantageous to cut two differently shaped compensating strips from one common profiled section with one profiled cover. This can be done if a common profiled section is initially manufactured for one profiled cover and one compensating strip for each side of the clamping extension, before the two compensating strips are separated from the profiled cover by means of a cut along the underside of the covering flange and along each side of the clamping extension. This provides two compensating strips for one covering strip, to be employed as required.

Manufacturing the profiled cover and the compensating strip or strips at the same time provides additional advantages for coated profiled covers and compensating strips as the structure and appearance of the coating of the profiled cover and the compensating strips are identical if the common profiled section is initially coated on what will become the visible side of the profiled cover and the compensating strip or strips, before then being separated into the profiled cover and compensating strip or strips. The difference between the abutting coatings of the abutting profiled cover and compensating strips can at the most involve changes at the kerfs, changes that are visually negligible owing to the minimal kerf widths.

If the profiled covers and the compensating strips are coated using droplets, as for instance with spray coating, vacuum deposition or vaporization, the common profiled section can first be cut along the underside of the covering flange and then be coated before the profiled cover and the compensating strip or strips are completely separated by cutting along each lateral surface of the clamping extension. This partial cut prior to coating has for instance the advantage that the partial coating of the cut between the covering flange and the compensating strip coats the longitudinal edges of the profiled cover and the compensating strip, an outcome that is not achieved if cutting is performed afterwards. In order to prevent the creation of a gap between the covering flange and the floor covering under the covering flange when covering the higher of the two floor surfaces, the cut along the underside of the covering flange of the profiled cover can run at an acute angle, requiring the covering flange to be undercut. This undercutting also causes the compensating strip to be centred due to the wedging effect when the profiled cover is subject to load, pressing the compensating strip against the abutment.

If the kerfs of the cuts along the underside of the covering flange and the lateral surfaces of the clamping extension only overlap in part of the kerf width, a step is created in the section of kerf overlap that advantageously serves as an abutment for the compensating strip that is pressed against it by the fixture, achieving exact positioning of the compensating strip with respect to the profiled cover.

BRIEF DESCRIPTION OF THE DRAWING

The drawing illustrates examples of embodiments of the invention. In the drawing

DESCRIPTION OF THE PREFERRED EMBODIMENT

Figure 1:
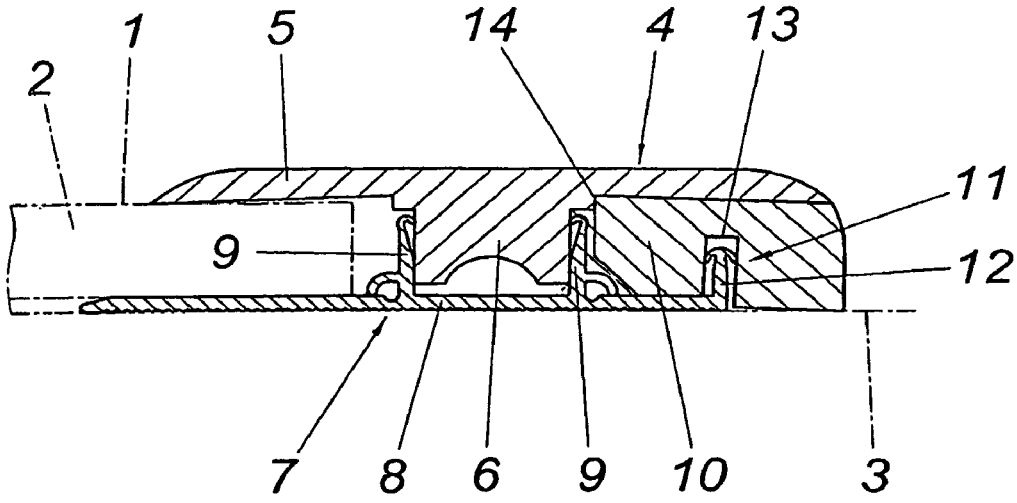
FIG. 1 shows a device in accordance with the invention for bridging a difference in height between two floor surfaces in a simplified cross-section.

In accordance with the embodiment in FIG. 1, a difference in height between a floor surface 1, for instance a floor covering 2, and a floor surface 3 requires bridging, with the latter floor surface 3 in accordance with the embodiment being formed by the substrate for the floor covering 2. The floor surface 3 can of course also be formed by another floor covering. A profiled cover 4 is employed to bridge the difference in height between the floor surfaces 1 and 3, said profiled cover 4 consisting of a covering flange 5 and a clamping extension 6 protruding downwards from the covering flange 5, said clamping extension being held and gripped in a fixture 7. This fixture 7 is developed as a profiled section, having resilient retaining legs 9 protruding upward from a mounting plate 8, with the clamping extension 6 of the profiled cover 4 being engaged by said legs.

As the profiled cover 4 is developed symmetrically with respect to a longitudinal middle plane, the profiled cover cannot bridge the difference in height between the floor surfaces 1 and 3. Accordingly, to bridge this difference in height, provision is made for a compensating strip 10, which attaches to the underside of the covering flange 5 of the profiled cover 4 on the side with the lower floor surface 3 and rests on this floor surface 3. To ensure a flush connection between the compensating strip 10 and the covering flange 5, without provision having to be made for a form-fitting connection between these structural components, the fixture 7 forms a clamping seat 11 for the compensating strip 10. To this end, the mounting plate 8 extends past the retaining legs 9 and bears a retaining leg 12 at the longitudinal edge of the extension, said retaining leg 12 being inserted into a longitudinal groove 13 in the compensating strip 10. The covering flange 5 of the profiled cover 4 forms an abutment 14 in the vicinity of the clamping extension 6 for the compensating strip 10, which is pressed against this abutment by the resilient pretensioning of the retaining leg 12 of the clamping seat 11, such that the compensating strip 10 is positioned precisely with respect to the profiled cover 4.

Accordingly, the difference in height between two floor surfaces 1 and 3 is bridged in an advantageous manner with the assistance of the compensating strip 10 in conjunction with a profiled cover 4 that is symmetrical with respect to a longitudinal middle plane, without impinging upon the use of the profiled cover as a cover for an expansion joint in the vicinity of a floor covering that does not differ in height around the expansion joint. This is achieved by fastening the compensating strip 10 by means of the clamping seat 11 of the fixture 7 as in this case a form-fitting connection between the covering flange 5 and the compensating strip 10 is not required. However, the clamping seat 11 of the fixture 7 for the compensating strip 10 does not preclude an adhesive joint between the compensating strip 10 and the adjacent section of the covering flange 5, which to this end can be provided with an adhesive strip, which is not represented for reasons of maintaining clarity. If the profiled cover 4 is used without the compensating strip 10, the widened section of the mounting plate 8 with the retaining leg 12 generally hinders positioning of the fixture 7. Therefore, the widened section of the mounting plate 8 with the retaining leg 12 is provided with a predetermined breaking point immediately adjacent to the profiled section of the fixture 7, as indicated in FIG. 1. Consequently, if required, the retaining leg 12 can be separated from the rest of the profiled section, together with the widened section of the mounting plate 8.

Figure 2:
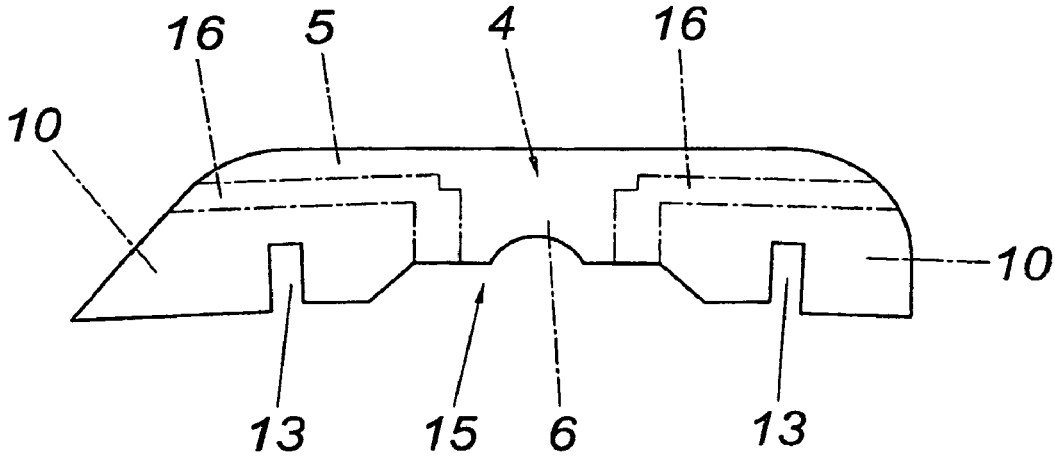
FIG. 2 shows a frontal view of a common profiled section for producing a profiled cover and two compensating strips.
Figure 3:
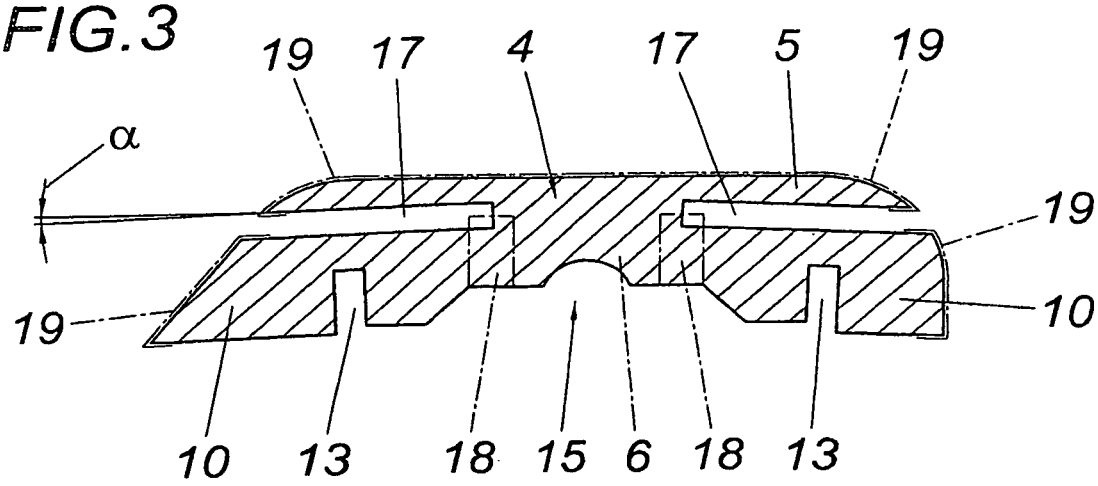
FIG. 3 shows a cross-sectional view of the profiled section in accordance with FIG. 2 after a separating cut along the underside of the covering flange of the subsequent profiled cover in cross-section.
Figure 4:
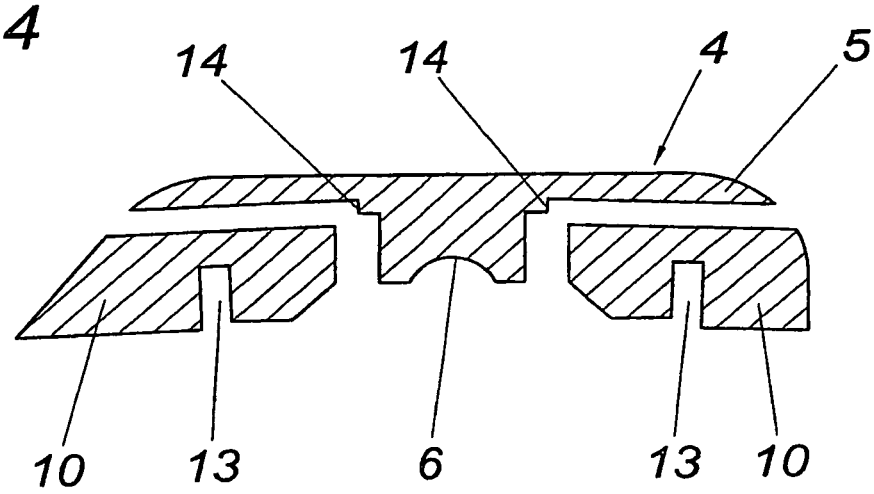
FIG. 4 shows a cross-sectional view of the covering strip produced from the profiled section in accordance with the FIG. 2 by cutting along the lateral surface of the clamping extension, with the two compensating strips in an arrangement corresponding with the profiled section.

Simply positioning the compensating strip 10 on the corresponding section of the covering flange 5 constitutes an advantageous condition for simple manufacturing of the compensating strip 10 and the profiled cover 4, as the profiled cover 4 and the compensating strip 10 can be manufactured from a common profiled section in accordance with FIGS. 2 to 4. In accordance with FIGS. 2 to 4 the common profiled section 15 encompasses not only one compensating strip 10, but also two compensating strips 10 of differing form, something that further expands the application options of the profiled cover 4 thanks to the optional use of either of the two compensating strips 10.

As can be seen in FIG. 2, the cross-section of the common profiled section 15 is comprised of cross-sections of the profiled cover 4 on the one hand and the compensating strips 10 on the other, with provision being made accordingly for machining allowances 16 for kerfs between the covering flange 5 and the clamping extension 6 of the cross-section of the profiled cover 4 as indicated by the dash-dotted line and the abutting compensating strips 10, the outline of which is also indicated by means of dash-dotted lines. FIG. 3 shows the compensating strips 10 partially separated from the subsequent profiled cover 4 by kerfs 17 along the underside of the covering flange 5. Complete separation is achieved by cutting along the lateral surfaces of the clamping extension 6, as indicated by the dash-dotted kerfs 18. The compensating strips 10 that are completely separated from the profiled cover 4 are visible in FIG. 4, specifically in a bilateral arrangement corresponding to the profiled section 15, on which the device is based. It is demonstrated that the profiled cover 4 and the compensating strips 10 can be produced from the same profiled section 15 by simple, straight cuts corresponding to kerfs 17 and 18, and in fact with the advantage that unavoidable cutting inaccuracies are compensated when the profiled cover 4 and the compensating strips are placed together.

In accordance with FIG. 3, the kerfs 17 and 18 only overlap for a section of the kerf width along the underside of the covering flange 5 and along the lateral surfaces of the clamping extension 6 such that a step is produced in the vicinity of the clamping extension 6 of the profiled cover 4, said step able to serve as an abutment 14 for the corresponding compensating strip 10.

In order to avoid gaps at the edges between the covering flange 5 extending over the floor surface 1 and the floor covering 2, the covering flange 5 must form an undercut so that the longitudinal edge of the covering flange 5 is reliably supported on the floor covering 2, as shown in FIG. 1. In order to achieve such an undercut during manufacture of the profiled cover 4, the kerfs 17 only need to run at an acute angle $\alpha$ with respect to the covering flange 5, as shown in FIG. 3. The corresponding inclination of the upper side of the compensating strips 10 formed by the kerfs 17 provides the advantage that the section of the covering flange 5 in the vicinity of the compensating strip 10 is supported across the full surface of the compensating strip 10.

Manufacturing the profiled cover 4 and the compensating strips 10 from a common profiled section 15 also ensures advantageous conditions for coating the visible surfaces of the profiled cover 4 and the compensating strips 10 in a similar manner as the profiled cover 4 and compensating strips 10 can be coated at the same time as part of the profiled section 15. Differences regarding the surface structure and the appearance of the coating can only occur as a result of changes near the kerfs 17 when the compensating strips 10 are separated from the profiled cover 4 after the common profiled section 15 has been coated. This separation by means of the kerfs 17 can be performed prior to or after coating, depending on the type of coating. Cutting along the kerfs 17 is recommended after coating with a foil for instance in order to achieve the smoothest transition possible between the coating structure and the appearance of the coating between the compensating strips 10 and the profiled cover 4. On the other hand, in the case of spray coating, for instance varnishing, it is best to cut along the underside of the covering flange of the common profiled section 15 before coating in order to coat the edges producing by the kerfs 17 as indicated by the dot-dashed lines in FIG. 3, which indicate the spray coating 19 that extends over the edges and into the kerfed areas.

What is claimed is:

1. Method for the production of a profiled cover and at least one compensating strip for a device for bridging a difference in height between two floor surfaces, the device having a profiled cover provided with one covering flange that extends over the edges of the two floor surfaces and at least one clamping extension that protrudes downward from the covering flange, extending longitudinally with respect to the profiled cover and engaging with a fixture by means of clamping, and having a compensating strip between the covering flange of the profiled cover and the lower of the two floor surfaces, wherein the fixture (7) is developed as a clamping seat (11) for the compensating strip (10), wherein firstly a common profiled section (15) is produced, the cross-section of which is constituted by the cross-section of the profiled cover (4) and at least one adjoining compensating strip (10), including machining allowances (16) for kerfing (17, 18) on the underside of the covering flange (5) on the one hand and on the lateral surface of the clamping extension (6) on the other, with the compensating strip then being separated from the profiled cover (4) by cutting along the underside of the covering flange (5) and the lateral surface of the clamping extension (6).

2. A method in accordance with claim 1, wherein a common profiled section (15) for a profiled cover (4) and two compensating strips (10) provided for either side of the clamping extension (6) is produced before the compensating strips (10) are separated by means of one cut each along the underside of the covering flange (5) and each lateral surface of the clamping extension (6).

3. A method in accordance with claim 1, wherein the common profiled section (15) is firstly coated on the surfaces of the profiled cover (4) and the compensating strip (10) or compensating strips (10) that will subsequently be visible and then the profiled cover (4) and the compensating strip (10) or compensating strips (10) are separated.

4. A method in accordance with claim 1, wherein the profiled section (15) is cut along the underside of the covering flange (5) and then coated if the coating material is applied in droplets to the subsequently visible sides of the profiled cover (4) and the compensating strip (10) or compensating strips (10) before the profiled cover (4) and the compensating strip (10) or compensating strips (10) are separated from each other by a cut along each of the lateral surfaces of the clamping extension (6).

5. A method in accordance with claim 1, wherein the cut along the underside of the covering flange (5) of the profiled cover (4) runs at an acute angle ($\propto$) to create an undercut with respect to the covering flange (5).

6. A method in accordance with claim 1, wherein the kerfs (17, 18) of the cuts along the underside of the covering flange (5) and along the lateral surface of the clamping extension (6) only overlap for a section of the kerf widths.

* * * * *